United States Patent [19]

Kubik

[11] 4,005,734

[45] Feb. 1, 1977

[54] HYDRAULIC DIRECTIONAL MEMORY UNIT

[76] Inventor: Philip A. Kubik, 6809 Spruce Drive, Birmingham, Mich. 48010

[22] Filed: Aug. 18, 1975

[21] Appl. No.: 605,715

[52] U.S. Cl. ..... 137/625.63; 137/625.64; 137/596.17; 91/459

[51] Int. Cl.[2] ..... F15B 21/08

[58] Field of Search ..... 137/625.63, 625.64, 137/596.16, 596.17; 251/30, 26; 91/461, 459

[56] References Cited

UNITED STATES PATENTS 3,762,076 10/1973 Eftefield ..... 91/459 X

*Primary Examiner*—Alan Cohan
*Attorney, Agent, or Firm*—Basile, Weintraub and Vanophem

[57] ABSTRACT

A fluid system having a source of fluid pressure such as a fluid pump connected to a fluid user such as a fluid motor is provided with a directional control valve between the fluid source and the fluid user for selectively controlling its direction of movement. The directional control valve is a three-position, tandem-center, pilot operated four-way valve which, in the preferred embodiment of the invention, is modified to include a two-position, four-way directional control valve between the pilot valve and the main valve of the system to provide a hydraulic memory.

1 Claim, 1 Drawing Figure

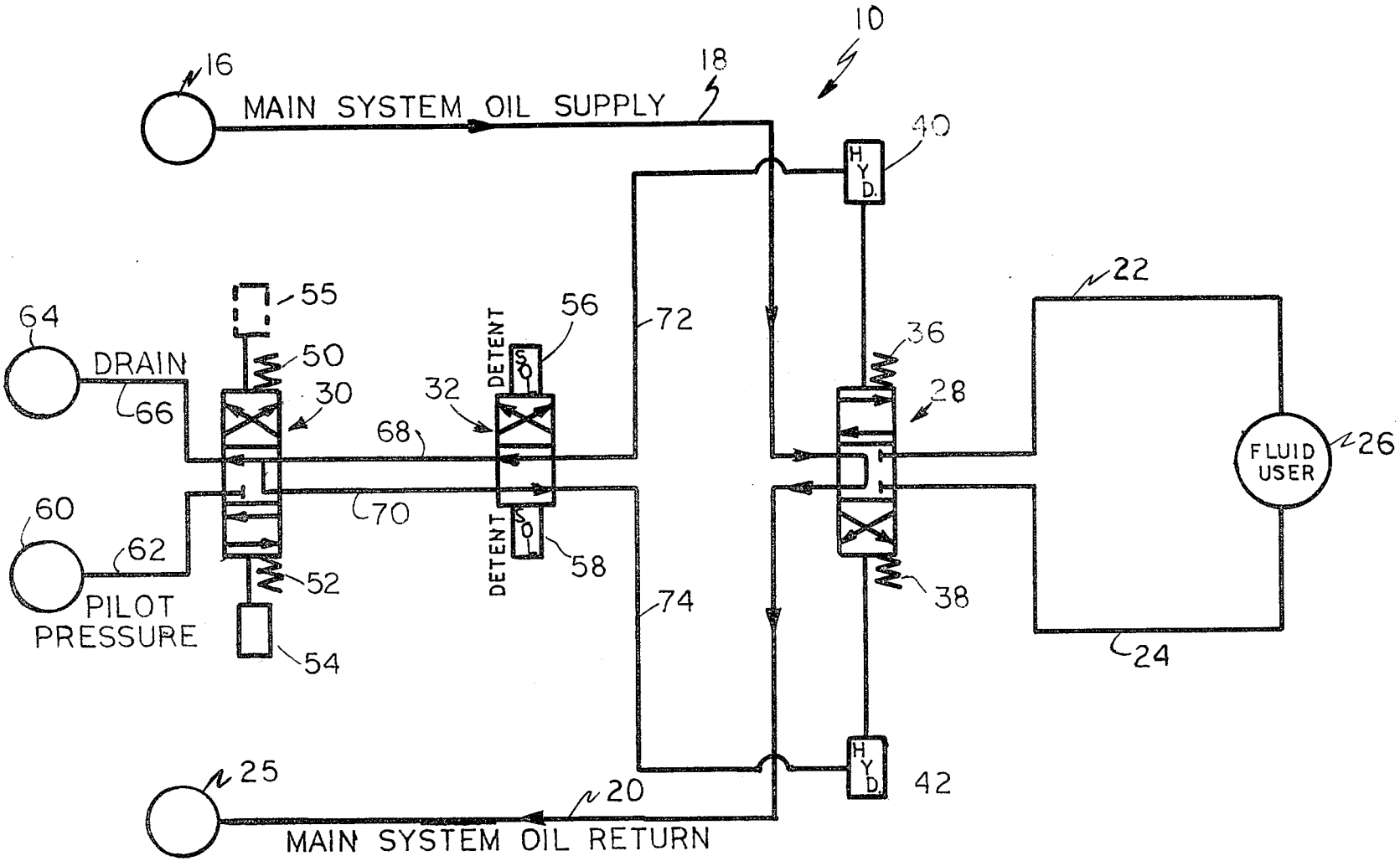
FLUID USER
26
22
24
28
36
38
40
42
HYD
HYD
10
18
MAIN SYSTEM OIL SUPPLY
72
74
20
MAIN SYSTEM OIL RETURN
56
58
DETENT
DETENT
32
68
70
55
50
30
52
54
16
25
DRAIN
66
62
PILOT PRESSURE
64
60

HYDRAULIC DIRECTIONAL MEMORY UNIT

CROSS REFERENCE TO RELATED PATENTS

The present invention is related in substance to U.S. Pat. No. 3,653,208, issued on Apr. 4, 1972, and the same is incorporated herein by reference.

BACKGROUND OF THE INVENTION

I. Field of the Invention

The present invention relates to a fluid system for controlling the movement of a fluid motor and, in particular, the present invention relates to a hydraulic memory unit for a directional control valve.

II. Description of the Prior Art

Heretofore numerous fluid systems have been employed for directing fluid under pressure from a pump to a fluid motor, such as a rotary motor or a cylinder. In the aforementioned U.S. Pat. No. 3,653,208 it was suggested that a pump could be connected in a closed-loop circuit to a fluid motor with the direction of movement of the motor being controlled by a fourway directional control valve incorporated in the circuit between the pump and the motor. In such a system the fourway valve is of the tandem center type; and, thus, in the event of a power failure, springs within the four-way valve automatically center the spool of the valve such that operation of the motor is terminated. Thus, upon reactuation of the system it is not automatically determined what the direction of movement of the motor was prior to the power failure. It would thus be desirable to provide a simple means for modifying conventional directional control valves of the type disclosed herein wherein fluid will be directed to its original path upon reactivation of a system subsequent to a power failure.

SUMMARY OF THE INVENTION

The present invention, which will be described subsequently in greater detail, comprises a fluid system having a three-position, four-way directional control valve which is modified such that the valve is operable to direct flow to a selected flow path upon being re-energized subsequent to a power failure.

It is therefore an object of the present invention to provide a new and improved directional control valve for fluid systems of the type wherein fluid is directed from a fluid source to a fluid user.

Other objects, advantages, and applications of the present invention will become apparent to those skilled in the art of fluid systems when the accompanying description of one example of the best mode contemplated for practicing the invention is read in conjunction with the accompanying drawing.

BRIEF DESCRIPTION OF THE DRAWING

The description herein make reference to the accompanying drawing wherein the sole figure represents a schematic illustration of the present invention incorporated in a fluid system.

DESCRIPTION OF THE PREFERRED EMBODIMENT

Referring now to the drawing wherein there is illustrated a fluid system 10 comprising a source 16 of fluid pressure such as a main system oil supply which may be a fluid pump. The source 16 is connected via conduits 18, 22, and 24 to a fluid user 26 such as a fluid motor which may be a rotary motor or a fluid cylinder depending upon the particular application. The fluid user 26 is connected to the main system oil return 25 by conduits 20, 22, and 24. Incorporated within the circuit 10 is a threeposition, tandem-center, four-way directional control valve 28 which is pilot operated by directional control valves 30 and 32 in a manner which will be described in greater detail hereinafter. The system may be an open or closed-loop system depending upon the particular application.

As is now conventional with systems of the type described herein, the system 10 may be provided with pressure relief valves for limiting the pressure of the system, check valves for replenishing the system, and a suitable control circuit for controlling the rate of flow from the pump, all of which are described in greater detail in the aforementioned U.S. Pat. No. 3,653,208 and thus need not be described herein in greater detail.

The directional control valve 28 is centered to the tandem position by suitable springs 36 and 38 while hydraulic pistons 40 and 42 operate in the conventional manner when communicated alternately and selectively to a pilot pressure to shift the valve spool. In the present example, when fluid under pressure is communicated to the hydraulic piston 40, the valve 28 is shifted such that high-pressure fluid from the fluid source 16 via the conduit 18 is communicated to the conduit 22 so as to move the fluid user 26 in a first direction. Fluid is returned from the fluid user 26 via conduit 24, directional control valve 28, and directed to the main system oil return 25 by means of conduit 20. Removal of the fluid pressure from the hydraulic piston 40 results in the directional control valve 28 being shifted to the tandem position by the action of the spring 38 whereby the fluid user 26 is stopped and the fluid from the conduit 18 is directed to the conduit 20 via the directional control valve 28.

Alternately, when fluid under pressure is directed to the hydraulic piston 42, the same will cause the directional control valve 28 to shift such that fluid under pressure is directed from the fluid source 16 via conduits 18 and 24 to the fluid user 26 thereby reversing its direction of movement, while fluid is returned from the fluid user 26 via conduits 22 and 20. Removal of pressure from the hydraulic piston 42 results in the directional control valve 28 being shifted to the tandem position by the action of the spring 36 whereby the fluid user 26 is stopped and fluid flows from conduit 18 to conduit 20 via the control valve 28.

In conventional systems fluid is communicated to the hydraulic pistons 40 and 42 of the directional control valve 28 by means of a pilot valve that was generally a three-position, four-way directional control valve which selectively communicated fluid under pressure to one of the hydraulic pistons of the directional control valve to obtain the aforementioned, described shifting of the valve 28.

In such prior art systems, if a power failure occurred during operation, the pilot operated valve would automatically become centered whereupon the selected hydraulic piston 40 or 42 would be communicated to the reservoir and the four-way directional control valve 28 would be centered by the action of the springs 36 and 38 thereby stopping the motor. Upon reactuation of the system the motor would not operate as the directional control valve 28 would be in a tandem position. It would be necessary to make a visual inspection of the system to determine what the proper direction of rotation of the motor should be, and the directional control valve or pilot valve would have to be properly actuated. It is the present invention which eliminates this difficulty by providing a simple means for insuring that fluid is directed to the proper conduit of the system to have the fluid user operate in the same direction as it had been operating prior to the power failure, all the same being accomplished with a simple modification of the pilot-operated directional control valve.

The hydraulic directional memory features of the present invention are incorporated into the inventive system by modifying the conventional pilot valve 30, such that the same is converted into a two-position valve which is spring centered by springs 50 and 52 and shifted to an operable position by means of solenoid 54. The original solenoid 55 is made to be inoperative. The system further comprises a memory valve 32 which is a two-position valve operated by means of solenoids 56 and 58. The valve 32 is of the detent type; that is, when one of the solenoids 56 or 58 is de-energized, the valve will remain at its last position and will not be removed from that position until the other solenoid is actuated. An example of a solenoid-operated detent mechanism for use in conjunction with the spool utilized by the directional control valve 32 may be had by reference to U.S. Pat. No. 3,790,129; however, such detent-type mechanisms are well known in the art, and a further detailed description of them is not necessary.

In the present system the fluid under pressure is communicated from a source 60 of pilot pressure via a conduit 62 to the inlet port of the pilot valve 30. A second port of the valve 30 is communicated to a suitable drain 64 by means of a conduit 66. The outlet side of the valve 30 is connected by conduits 68 and 70 to the inlet ports of the valve 32. The valve 32, in turn, is connected by conduits 72 and 74, respectively, to the hydraulic pistons 40 and 42 of the four-way directional control valve 28.

In normal operation, when it is desired to shift the directional control valve 28 so as to direct fluid under pressure from the conduit 18 to the conduit 22, the solenoid 54 and the solenoid 56 are both simultaneously actuated. Actuation of the solenoid 54 communicates fluid under pressure from the pilot source 60 via conduit 62 to the conduit 70, while actuation of the solenoid 56 causes fluid from the conduit 70 to be communicated to the conduit 72 which, in turn, directs fluid under pressure to the hydraulic piston 40 whereby control valve 28 is so shifted as to communicate conduits 18 and 22, as aforementioned. At the same time the hydraulic piston 42 is communicated to the drain 64 by means of conduits 74, 66, and 68.

In the event of a power failure the solenoid 54 would be de-energized and valve 30 would be returned to its center position whereupon the hydraulic piston 40 would be communicated directly to drain 64 as illustrated in the figure. Communication of the hydraulic piston 40 to the drain 64 results in the centering to the tandem position of the valve 28 by the action of the springs 36 and 38 whereupon the fluid user 26 will cease to operate, as aforementioned. Once the system is re-energized, it is simply a matter of actuating solenoid 54 in order for fluid from the pilot pressure source 60 to be directed to the hydraulic piston 40 so as to shift the four-way directional control valve 28 to the original position that existed subsequent to the power failure so that fluid under pressure is directed from conduit 18 to conduit 22. This occurs even though the solenoid 56 was de-energized as the valve 32 is maintained in its original position due to the detent action hereinbefore described.

Similarly, if it is desired to communicate fluid under pressure from the conduit 18 to the conduit 24, then it is necessary to actuate both solenoids 54 and 58 whereupon fluid is directed from the pilot pressure source 60 via conduits 62, 70, and 74 to the hydraulic piston 42 whereupon the same is actuated in the aforementioned manner to shift valve 28 and connect the conduits 18 and 24. A power failure will result in the centering of the valve 30 whereby fluid is exhausted from hydraulic piston 42 to permit the centering of the valve 28 and the termination of the operation of the fluid user 26. However, due to the detent action in the valve 32, the valve 32 will remain in the position illustrated whereby subsequent actuation of the solenoid 54 when power is obtained will communicate fluid under pressure to the hydraulic piston 42 so as to reactuate the directional control valve 28 to its original position; that is, the position which permits fluid communication between the conduits 18 and 24 to permit continued operation of the motor in its original direction that existed prior to the power failure.

It should be noted that the pilot pressure source 60 may be from a separate charge pump or from the main system source as desired. Similarly, the drain 64 may be a reservoir or the main system oil return as desired.

It can thus be seen that the present invention has provided a very simple and unique manner for modifying valves to provide for a hydraulic directional memory that provides safety in machine operation should a power failure occur since, with power resumption, the machine may continue as originally programmed.

It should be noted that the spool of the main valve 28 may be of any desired configuration as the memory aspects of the present invention are derived from the detent memory valve 32.

It should also be noted that the present invention provides several advantages in that the main oil flow is through only one valve which allows for a compact memory valve arrangement; holds internal leakage to a minimum and permits retrofit from a non-memory valve to a memory system in a simple and inexpensive manner.

While only one example of the present invention has been disclosed, it should be understood by those skilled in the art of fluid systems and directional control valves for such systems that other forms of the present invention may be had without departing from the spirit of the present invention or the scope of the appended claims.

What is claimed is as follows:

1. A directional control valve for selectively communicating a fluid source to a fluid user, said directional control valve comprising first valve means shiftable from a first position communicating said fluid source to said fluid user to a second position wherein said fluid source and fluid user are not in fluid communication, said first valve means having pressure responsive means operable upon being communicated to a second source of fluid pressure for communicating said fluid source to said fluid user and being operable to terminate said communication when said pressure responsive means is not in communication with said second source of fluid pressure; and second and third pilot valve means operable upon actuation to communicate said pressure responsive means to said second source of fluid pressure, first power operated means for actuating said second pilot valve means; second power operated means for actuating said third pilot valve means; one of said pilot valve means being positioned to terminate said communication with said second source of fluid pressure when the power operated means associated therewith is de-energized; the other of said pilot valve means being positioned between two operable positions upon actuation and remaining in one of said positions when its associated power operated means is de-energized.

* * * * *